US010984736B2

(12) United States Patent
Xi et al.

(10) Patent No.: US 10,984,736 B2
(45) Date of Patent: Apr. 20, 2021

(54) IMAGE DISPLAY PROCESSING METHOD AND DEVICE THEREOF, DISPLAY DEVICE AND STORAGE MEDIUM

(71) Applicant: BOE TECHNOLOGY GROUP CO., LTD., Beijing (CN)

(72) Inventors: Yanhui Xi, Beijing (CN); Ming Chen, Beijing (CN); Xiaomang Zhang, Beijing (CN); Yan Sun, Beijing (CN); Bin Dai, Beijing (CN); Zhihua Ji, Beijing (CN); Tiankuo Shi, Beijing (CN); Yuxin Bi, Beijing (CN); Lingyun Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1 day.

(21) Appl. No.: 16/391,892

(22) Filed: Apr. 23, 2019

(65) Prior Publication Data

US 2020/0027408 A1 Jan. 23, 2020

(30) Foreign Application Priority Data

Jul. 20, 2018 (CN) ..... 201810803352.9

(51) Int. Cl.
*G09G 3/34* (2006.01)

(52) U.S. Cl.
CPC ... *G09G 3/3426* (2013.01); *G09G 2320/0646* (2013.01); *G09G 2330/021* (2013.01); *G09G 2360/16* (2013.01)

(58) Field of Classification Search
CPC ..... G09G 3/342; G09G 3/3426; G09G 3/36; G09G 3/3611; G09G 2320/0646; G09G 2330/21; G09G 2360/16
See application file for complete search history.

(56) References Cited

U.S. PATENT DOCUMENTS 10,872,558 B2 * 12/2020 Ji ..... G09G 3/3426
2002/0130830 A1 9/2002 Park
(Continued)

FOREIGN PATENT DOCUMENTS

CN 1375814 A 10/2002
CN 102074213 A 5/2011
(Continued)

OTHER PUBLICATIONS

First Chinese Office Action dated Aug. 2, 2019.

*Primary Examiner* — Mihir K Rayan
(74) *Attorney, Agent, or Firm* — Dilworth & Barrese, LLP.; Michael J. Musella, Esq.

(57) ABSTRACT

An image display processing method for a display device, an image display processing device, a display device and a storage medium are provided. The display device includes a backlight unit, the backlight unit includes a plurality of backlight blocks and is driven by a local dimming mode, and the image display processing method includes: acquiring a regional eigenvalue of each backlight block of an (n)th frame image and a regional eigenvalue of each backlight block of an (n−1)th frame image; and performing a peak driving processing on a backlight luminance of each backlight block of the (n)th frame image, based on a preset threshold, the regional eigenvalue of each backlight block of the (n)th frame image and the regional eigenvalue of each backlight block of the (n−1)th frame image, so as to acquire an adjusted backlight luminance of each backlight block of the (n)th frame image.

13 Claims, 4 Drawing Sheets

(56) References Cited

U.S. PATENT DOCUMENTS

| | | | | |
|---|---|---|---|---|
| 2011/0115779 | A1 | 5/2011 | Fujikawa | |
| 2016/0210908 | A1 | 7/2016 | Seki | |
| 2018/0075813 | A1 | 3/2018 | Zhang et al. | |
| 2018/0218690 | A1 | 8/2018 | Zhou et al. | |
| 2019/0147804 | A1* | 5/2019 | Zha | G09G 3/3406 345/691 |
| 2020/0243025 | A1* | 7/2020 | Xi | G09G 3/3426 |

FOREIGN PATENT DOCUMENTS

| | | | | |
|---|---|---|---|---|
| CN | 104637455 | A | 5/2015 | |
| CN | 105556587 | A | 5/2016 | |
| CN | 106023905 | A | 10/2016 | |
| CN | 106297674 | A | 1/2017 | |
| CN | 107424572 | A | 12/2017 | |
| CN | 107507580 | A | 12/2017 | |
| CN | 107610060 | A | 1/2018 | |
| WO | WO2019095425 | A1 * | 5/2019 | G09G 3/34 |

* cited by examiner

IMAGE DISPLAY PROCESSING METHOD AND DEVICE THEREOF, DISPLAY DEVICE AND STORAGE MEDIUM

TECHNICAL FIELD

Embodiments of the present disclosure relate to an image display processing method for a display device, an image display processing device, a display device and a storage medium.

BACKGROUND

Along with the continuous progress of electronic technology, Virtual Reality (VR) or Augmented Reality (AR) technology, as a kind of high and new technology, has been applied more and more in daily life such as games, entertainment and the like. Virtual reality technology is also called as immersive technology or artificial environment.

The existing virtual reality system mainly simulates a virtual, three-dimensional world through a high-performance computing system with a central processor, and provides a user with visual, auditory and other sensory experience through a head-mounted device, thus making the user feel like being present. Moreover, the human-computer interaction can also be carried out.

SUMMARY

At least one embodiment of the present disclosure provides an image display processing method for a display device, the display device comprises a backlight unit, the backlight unit comprises a plurality of backlight blocks and is driven by a local dimming mode, and the image display processing method comprises: acquiring a regional eigenvalue of each backlight block of an (n)th frame image and a regional eigenvalue of each backlight block of an (n−1)th frame image; performing a peak driving processing on a backlight luminance of each backlight block of the (n)th frame image, based on a preset threshold, the regional eigenvalue of each backlight block of the (n)th frame image and the regional eigenvalue of each backlight block of the (n−1)th frame image, so as to acquire an adjusted backlight luminance of each backlight block of the (n)th frame image; and displaying the (n)th frame image based on the adjusted backlight luminance of each backlight block of the (n)th frame image; n is an integer greater than 1.

For example, in an image display processing method provided by an embodiment of the present disclosure, performing the peak driving processing on the backlight luminance of each backlight block of the (n)th frame image based on the preset threshold, the regional eigenvalue of each backlight block of the (n)th frame image and the regional eigenvalue of each backlight block of the (n−1)th frame image so as to acquire the adjusted backlight luminance of each backlight block of the (n)th frame image comprises: judging whether a regional eigenvalue of an (i, j)th backlight block of the (n)th frame image is greater than the preset threshold; judging whether the regional eigenvalue of the (i, j)th backlight block of the (n)th frame image is equal to a regional eigenvalue of an (i, j)th backlight block of the (n−1)th frame image; and in a case where the regional eigenvalue of the (i, j)th backlight block of the (n)th frame image is greater than the preset threshold, and the regional eigenvalue of the (i, j)th backlight block of the (n)th frame image is unequal to the regional eigenvalue of an (i, j)th backlight block of the (n−1)th frame image, performing a peak driving processing on a backlight luminance of the (i, j)th backlight block of the (n)th frame image, so as to acquire an adjusted backlight luminance of the (i, j)th backlight block of the (n)th frame image, otherwise, not performing the peak driving processing on the backlight luminance of the (i, j)th backlight block of the (n)th frame image; $1 \le i \le I$, $1 \le j \le J$, I and J are integers greater than 1, and I and J respectively represent a row number and a column number of an array in which the plurality of backlight blocks are arranged.

For example, in an image display processing method provided by an embodiment of the present disclosure, the adjusted backlight luminance is expressed as:

$$L_{1(n)}(i, j) = (1 + A) * \frac{G_{(n)}(i, j)}{Hm} * L_{max},$$

where $L_{1(n)}(i, j)$ represents an adjusted backlight luminance of an (i, j)th backlight block of the (n)th frame image, A represents a backlight luminance adjustment coefficient, $G_{(n)}(i, j)$ represents a regional eigenvalue of the (i, j)th backlight block of the (n)th frame image, Hm represents a highest grayscale value, and $L_{max}$ represents a backlight luminance corresponding to the highest grayscale value.

For example, in an image display processing method provided by an embodiment of the present disclosure, in a case where the peak driving processing is not performed on the backlight luminance of the (i, j)th backlight block of the (n)th frame image, a backlight luminance corresponding to the regional eigenvalue of the (i, j)th backlight block of the (n)th frame image is expressed as:

$$L_{2(n)}(i, j) = \frac{G_{(n)}(i, j)}{Hm} * L_{max},$$

where $L_{2(n)}(i, j)$ represents the backlight luminance of the (i, j)th backlight block of the (n)th frame image without the peak driving processing, $G_{(n)}(i, j)$ represents the regional eigenvalue of the (i, j)th backlight block of the (n)th frame image, Hm represents a highest grayscale value, and $L_{max}$ represents a backlight luminance corresponding to the highest grayscale value Hm.

For example, in an image display processing method provided by an embodiment of the present disclosure, displaying the (n)th frame image based on the adjusted backlight luminance of each backlight block of the (n)th frame image comprises: obtaining a backlight diffusion model by fitting based on the adjusted backlight luminance of each backlight block, and acquiring an actual backlight luminance of each pixel in each backlight block based on the backlight diffusion model; compensating display data of the display device according to the actual backlight luminance, so as to obtain compensated display data; and displaying the (n)th frame image by using the compensated display data and the actual backlight luminance.

For example, in an image display processing method provided by an embodiment of the present disclosure, the regional eigenvalue of the (i, j)th backlight block of the (n)th frame image is expressed as:

$$G_{(n)}(i,j)=k*G_{(n)max}(i,j),$$

where k represents an adjustment coefficient, $G_{(n)}(i, j)$ represents the regional eigenvalue of the (i, j)th backlight block of the (n)th frame image, and $G_{(n)max}(i, j)$ represents a maximum of grayscale values of the (i, j)th backlight block of the (n)th frame image.

For example, in an image display processing method provided by an embodiment of the present disclosure, a value range of the adjustment coefficient is 0.85 to 1.00.

At least one embodiment of the present disclosure further provides an image display processing device, comprising: a regional eigenvalue acquisition circuit, configured to acquire a regional eigenvalue of each backlight block of an (n)th frame image and a regional eigenvalue of each backlight block of an (n−1)th frame image; an adjusted backlight luminance acquisition circuit, configured to perform a peak driving processing on a backlight luminance of each backlight block of the (n)th frame image, based on a preset threshold, the regional eigenvalue of each backlight block of the (n)th frame image and the regional eigenvalue of each backlight block of the (n−1)th frame image, so as to acquire an adjusted backlight luminance of each backlight block of the (n)th frame image; and an image displaying circuit, configured to display the (n)th frame image based on the adjusted backlight luminance of each backlight block of the (n)th frame image; n is an integer greater than 1.

For example, in an image display processing device provided by an embodiment of the present disclosure, performing the peak driving processing on the backlight luminance of each backlight block of the (n)th frame image based on the preset threshold, the regional eigenvalue of each backlight block of the (n)th frame image and the regional eigenvalue of each backlight block of the (n−1)th frame image so as to acquire the adjusted backlight luminance of each backlight block of the (n)th frame image comprises: judging whether a regional eigenvalue of an (i, j)th backlight block of the (n)th frame image is greater than the preset threshold; judging whether the regional eigenvalue of the (i, j)th backlight block of the (n)th frame image is equal to a regional eigenvalue of an (i, j)th backlight block of the (n−1)th frame image; and in a case where the regional eigenvalue of the (i, j)th backlight block of the (n)th frame image is greater than the preset threshold, and the regional eigenvalue of the (i, j)th backlight block of the (n)th frame image is unequal to the regional eigenvalue of an (i, j)th backlight block of the (n−1)th frame image, performing a peak driving processing on a backlight luminance of the (i, j)th backlight block of the (n)th frame image, so as to acquire an adjusted backlight luminance of the (i, j)th backlight block of the (n)th frame image, otherwise, not performing the peak driving processing on the backlight luminance of the (i, j)th backlight block of the (n)th frame image; $1 \le i \le I$, $1 \le j \le J$, I and J are integers greater than 1, and I and J respectively represent a row number and a column number of an array in which the plurality of backlight blocks are arranged.

For example, in an image display processing device provided by an embodiment of the present disclosure, the adjusted backlight luminance is expressed as:

$$L_{1(n)}(i, j) = (1 + A) * \frac{G_{(n)}(i, j)}{Hm} * L_{max},$$

where $L_{1(n)}(i, j)$ represents an adjusted backlight luminance of an (i, j)th backlight block of the (n)th frame image, A represents a backlight luminance adjustment coefficient, $G_{(n)}(i, j)$ represents a regional eigenvalue of the (i, j)th backlight block of the (n)th frame image, Hm represents a highest grayscale value, and $L_{max}$ represents a backlight luminance corresponding to the highest grayscale value.

For example, in an image display processing device provided by an embodiment of the present disclosure, in a case where the peak driving processing is not performed on the backlight luminance of the (i, j)th backlight block of the (n)th frame image, a backlight luminance corresponding to the regional eigenvalue of the (i, j)th backlight block of the (n)th frame image is expressed as:

$$L_{2(n)}(i, j) = \frac{G_{(n)}(i, j)}{Hm} * L_{max},$$

where $L_{2(n)}(i, j)$ represents the backlight luminance of the (i, j)th backlight block of the (n)th frame image without the peak driving processing, $G_{(n)}(i, j)$ represents the regional eigenvalue of the (i, j)th backlight block of the (n)th frame image, Hm represents a highest grayscale value, and $L_{max}$ represents the backlight luminance corresponding to the highest grayscale value Hm.

At least one embodiment of the present disclosure further provides an image display processing device, comprising: a processor; a memory; and one or more computer program modules, being stored in the memory and configured to be executed by the processor, and comprising instructions to be executed for implementing the image display processing method provided by any embodiment of the present disclosure.

At least one embodiment of the present disclosure further provides a display device, comprising the image display processing device provided by any embodiment of the present disclosure.

At least one embodiment of the present disclosure further provides a display device, comprising a processor, a memory, and the image display processing device provided by any embodiment of the present disclosure, the processor, the memory and the image display processing device are connected to each other through a bus system.

At least one embodiment of the present disclosure further provides a storage medium, in which computer readable instructions are stored non-temporarily, and when the non-temporary, computer readable instructions are executed by a computer, the image display processing method provided by any embodiment of the present disclosure can be executed.

BRIEF DESCRIPTION OF THE DRAWINGS

In order to demonstrate clearly technical solutions of the embodiments of the present disclosure, the accompanying drawings in relevant embodiments of the present disclosure will be introduced briefly. It is apparent that the drawings may only relate to some embodiments of the disclosure and not intended to limit the present disclosure.

DETAILED DESCRIPTION

Figure 1A:
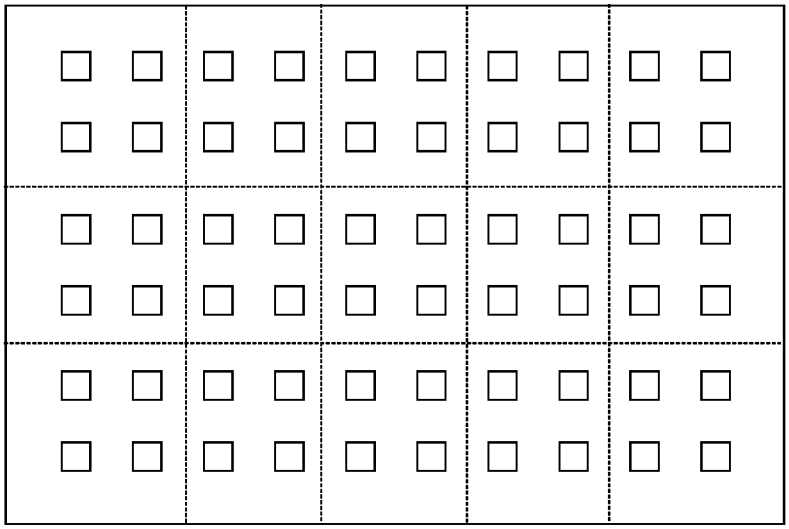
FIG. 1A is a schematic diagram of a backlight unit provided by an embodiment of the present disclosure.

In order to make objects, technical details and advantages of the embodiments of the disclosure apparent, the technical solutions of the embodiment will be described in a clearly and fully understandable way in connection with the drawings related to the embodiments of the disclosure. It is apparent that the described embodiments are just a part but not all of the embodiments of the disclosure. Based on the described embodiments herein, those skilled in the art can obtain other embodiment, without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

The embodiments of the present disclosure are described below with reference to the accompanying drawings. It should be noted that in the drawings, the same reference numerals are given to the components having substantially the same or similar structures and functions, and the repeated description thereof will be omitted.

A liquid crystal display panel includes a liquid crystal panel and a backlight unit. Generally, a liquid crystal panel includes an array substrate and an opposite substrate (for example, a color filter substrate) disposed opposite to each other to form a liquid crystal cell, and a liquid crystal layer is filled between the array substrate and the opposite substrate in the liquid crystal cell. A first polarizer is on the array substrate, and a second polarizer is on the opposite substrate, and a polarization direction of the first polarizer is perpendicular to a polarization direction of the second polarizer, for example. The backlight unit is on a non-display side of the liquid crystal panel for providing a planar light source for the liquid crystal panel. Liquid crystal molecules of the liquid crystal layer are twisted by a driving electric field formed between a pixel electrode on the array substrate and a common electrode on the array substrate (or a common electrode on the opposite substrate), so as to control a polarization direction of light passing through the liquid crystal molecules, and transmittance of the light is controlled by the cooperation of the first polarizer and the second polarizer, thereby realizing grayscale display. The backlight unit may be a direct-lit backlight unit or a side-lit backlight unit. A direct-lit backlight unit includes a plurality of point light sources (for example, LEDs) arranged side by side and a diffusion plate. Light emitted by the point light sources is homogenized by the diffusion plate, and then incident on the liquid crystal panel for display.

At present, for example, a high-resolution LCD panel has also been gradually applied to a VR device. During use of the VR device, because the distance between human eyes and a display screen is closer and it is easier to perceive the display effect of displayed images, requirements on resolution and display quality of the display panel are getting higher and higher.

For example, for a LCD panel, Local Dimming technology (LD) and Peak Driving technology (PD) may be used to control a direct-lit backlight unit, thereby enhancing display quality of the display panel. The local dimming technology can not only reduce the power consumption of the display panel, but also realize a dynamic adjustment of a backlight region, greatly improve a contrast of a display image, and improve the display quality of the display panel. On the basis of the local dimming technology, the contrast of the displayed image may be further improved by using the peak driving technology.

The local dimming technology can divide the entire backlight unit into a plurality of backlight blocks that can be individually driven, and each of the backlight blocks includes one or more LEDs. According to grayscales needed to be presented in different parts of the display image, the driving current for LEDs of backlight blocks corresponding to these parts is automatically adjusted, so individual adjustment of the brightness of each block in the backlight unit is realized, and thus the contrast of the display image can be improved. The local dimming technology is suitable for the direct-lit backlight unit, and multiple LEDs as light source are, for example, evenly distributed throughout the whole backpanel. Local dimming technologies are applicable to the direct-lit backlight unit, and a plurality of LEDs as the light sources are evenly distributed over an entire backplane, for example. For example, in an exemplary direct-lit backlight unit, a schematic diagram of dividing regions of the LED light sources in the entire backplane is shown in FIG. 1A. A small square as shown in FIG. 1A represents an LED unit, and a plurality of regions separated by broken lines represent a plurality of backlight regions. Each of the plurality of backlight regions includes one or more LED units and can be controlled independently of other backlight regions. For example, the LEDs in each of the plurality of backlight block are linked, for example, connected in series, that is, currents provided to the LEDs in a same backlight block are consistent.

Figure 1B:
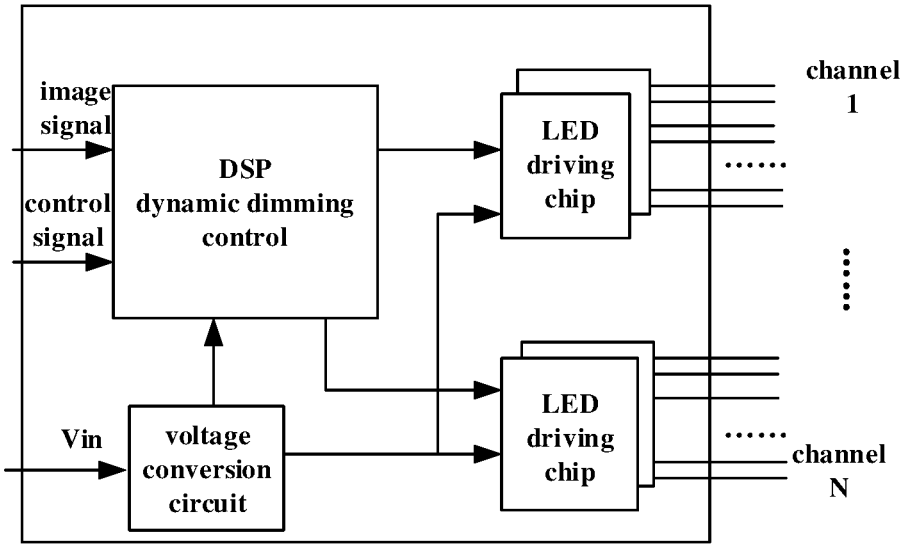
FIG. 1B is a schematic diagram illustrating an exemplary system for performing a local dimming of the backlight unit as shown in FIG. 1A.

FIG. 1B is a schematic diagram of an exemplary system for performing a local dimming processing on the backlight unit illustrated in FIG. 1A. As shown in FIG. 1B, a local dimming drive system includes a digital signal processor (DSP), and the digital signal processor processes each frame of image signal, and outputs grayscale information of each backlight block obtained after processing to a corresponding backlight block, so as to drive LEDs of the backlight block to emit light. For example, the digital signal processor may include a micro-chip unit (MCU) signal processing circuit. The MCU signal processing circuit receives a backlight local control signal (Local Dimming SPI (Serial Peripheral Interface) signal) from a FPGA (Field-Programmable Gate Array), a SOC (System on Chip), or a TCON (Timer Control Register), and the backlight local control signal is used in an "AND" operation with a brightness modulation signal (DIM_PWM) to obtain a brightness control signal of each of the plurality of backlight blocks. Then, the brightness control signal is output to a LED driving chip to implement current control of the LEDs of each of the plurality of backlight blocks, thereby controlling the luminance of each of the plurality of backlight blocks. For example, the system for performing the local dimming processing is powered by an external DC power source, and the supply voltage Vin of the power source 10 is typically 24 voltages (V). The system for performing the local dimming processing further includes a DC/DC circuit (not shown in FIG. 1B). For example, the DC/DC circuit can employ a voltage conversion circuit (e.g., a Boost circuit) to boost the supply voltage Vin to a driving voltage required by illuminating the LEDs of each of the plurality of backlight blocks, and inputs the driving voltage to the LEDs of each backlight block under the control of the brightness control signal output by the LED integrated circuit driving chip to drive the LEDs to emit light.

The backlight unit includes a plurality of rectangular backlight regions arranged in an array, and the local dimming technology can adjust the luminance of the corresponding backlight block according to grayscale of contents of an image displayed by a liquid crystal display panel. For the parts with higher luminance (grayscale) of the image, luminance of the corresponding backlight block is also high, and for the parts with lower luminance of the image, luminance of the corresponding backlight block is also low, thereby reducing the power consumption of the backlight unit, improving the contrast of the displayed image, and enhancing the display quality.

In the direct-lit backlight source, light emitted by a LED has a certain diffusion angle, which may cause light leakage in the backlight block. This will cause light emitted by a LED in a backlight block that needs to be highlighted to diffuse to a relatively dark backlight block. As a result, display luminance of the backlight block that needs to be highlighted cannot reach a display luminance actually required by the display image, and thereby affecting display quality of a corresponding liquid crystal display image. Therefore, the peak driving technology can be combined with the local dimming technology, so as to further enhance the luminance of the display luminance of the backlight block that needs to be highlighted. For example, the display luminance of the backlight block can be raised to above a display luminance that needs to be presented, so as to make up for a decrease of the display luminance caused by the problem of light leakage. Thus, display defect brought about by the problem of light leakage is avoided. For example, the peak driving technology can increase the current of LEDs of a corresponding backlight block by increasing the backlight value of the backlight block, thereby achieving adjustment of the display luminance of the backlight block.

In a peak driving solution, when a highlighted image is consistently displayed in a certain region of a screen (for example, a static image is displayed in the region), LED light-emitting devices of backlight blocks corresponding to this screen region will be in a peak driving state for a long period of time. Thus, these light-emitting devices may be aged prematurely, which may affect the service life of the display panel.

At least one embodiment of the present disclosure provides an image display processing method for a display device, the display device includes a backlight unit, and the backlight unit includes a plurality of backlight blocks and is driven by a local dimming mode. The method includes that, acquiring a regional eigenvalue of each backlight block of an nth (n is an integer greater than 1) frame image and a regional eigenvalue of each backlight block of an (n−1)th frame image; performing a peak driving processing on a backlight luminance of each backlight block of the (n)th frame image, based on a preset threshold, the regional eigenvalue of each backlight block of the (n)th frame image and the regional eigenvalue of each backlight block of the (n−1)th frame image, so as to acquire an adjusted backlight luminance of each backlight block of the (n)th frame image; and displaying the (n)th frame image based on the adjusted backlight luminance of each backlight block of the (n)th frame image.

At least one embodiment of the present disclosure further provides an image display processing device corresponding to the above image display processing method, a display device and a storage medium.

The image display processing method provided by the embodiments of the present disclosure can reduce the backlight power consumption of the backlight source and improve the contrast of the display image. Moreover, such a problem that, light-emitting devices in the backlight unit age prematurely as a result of the display panel being in the peak driving state for a long time, and so on can also be avoided. Consequently, service life of the display panel can be prolonged.

Hereinafter, embodiments of the present disclosure will be described in detail in conjunction with the attached drawings. It should be noted that, the same reference numeral in different attached drawings will be used to represent the same element as that has been described.

Figure 2:
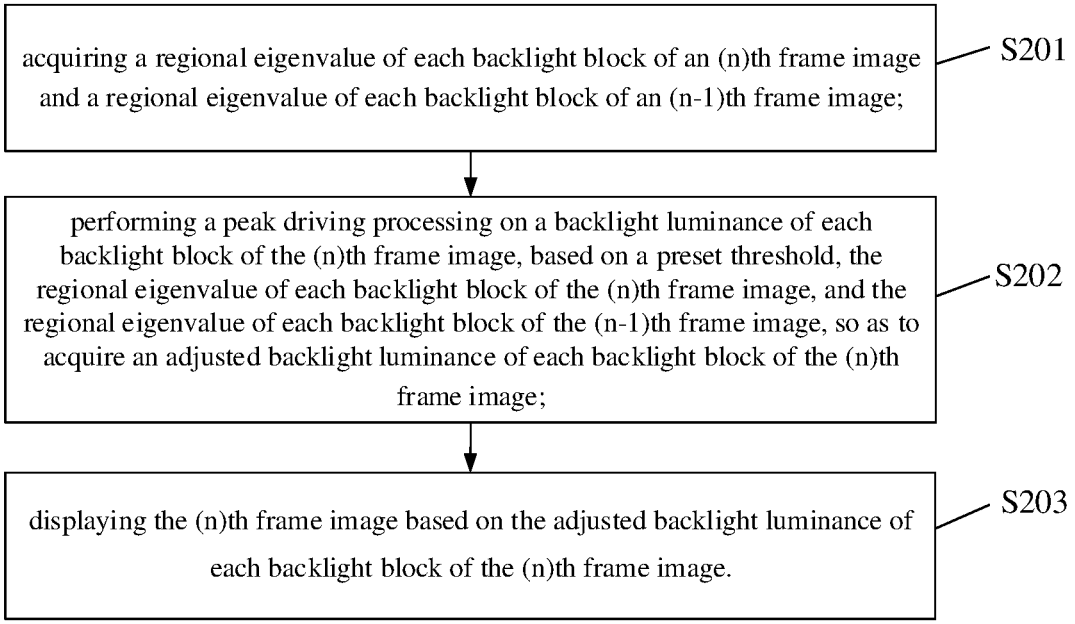
FIG. 2 is a flowchart of an example of an image display processing method provided by an embodiment of the present disclosure.

FIG. 2 is a flowchart of an image display processing method for a display device provided by some embodiments of the present disclosure. For example, the display device includes a backlight unit, and the backlight unit includes a plurality of backlight blocks and is driven by a local dimming mode. For example, the backlight blocks of the backlight unit can be set in a manner as shown in FIG. 1A, or can be set in other manners. For example, the display device is a liquid crystal display device (LCD), an electronic paper display device, or the like. For example, the image display processing method can be implemented at least partially in software, loaded and executed by a processor in the display panel, or at least partially implemented in hardware, firmware, etc., so as to solve the problem that light-emitting devices in the backlight unit age prematurely as a result of the display panel being in the peak driving state for a long time and so on.

For example, the LCD display device further includes a pixel array, a data decoding circuit, a timing controller, a gate driving circuit, a data driving circuit, a storage device (e.g., flash memory, etc.) and so on. The data decoding circuit receives display input signals and decodes the display input signals to obtain display data signals. The timing controller outputs timing signals to control the synchronous operation of the gate driving circuit, the data driving circuit and so on, and can perform a gamma correction on the display data signals, and input the processed display data signals to the data driving circuit for display operation. These components can be used in a conventional manner, and details are omitted here.

Hereinafter, the image display processing method of the display device provided by some embodiments of the present disclosure will be described with reference to FIG. 2. As shown in FIG. 2, the image display processing method includes steps S201 to S203, and the steps S201 to S203 of the image display processing method and their respective exemplary implementations will be described below, respectively.

Step S201: a regional eigenvalue of each backlight block of an nth (n is an integer greater than 1) frame image and a regional eigenvalue of each backlight block of an (n−1)th frame image are acquired.

Step S202: based on a preset threshold, the regional eigenvalue of each backlight block of the (n)th frame image and the regional eigenvalue of each backlight block of the (n−1)th frame image, a peak driving processing is performed on a backlight luminance of each backlight block of the (n)th frame image, so as to acquire an adjusted backlight luminance of each backlight block of the (n)th frame image.

Step S203: the (n)th frame image is displayed based on the adjusted backlight luminance of each backlight block of the (n)th frame image.

In the embodiments of the present disclosure, backlight blocks of any frame image correspond to backlight blocks of the display device.

In the above method, for example, the regional eigenvalue of each backlight block of the (n)th frame image is a maximum of grayscale values of each backlight block of the (n)th frame image before it is processed by a local dimming processing. For example, the maximum of grayscale values of each backlight block can be obtained by a one-by-one comparison, sorting, or other conventional way within the art, details being omitted here. It should be noted that, the regional eigenvalue of each backlight block of the (n)th frame image can also be a certain proportion of the maximum of grayscale values of each backlight block of the (n)th frame image, and for example, the proportion is 90%, 85%, or the like. The specific value of the proportion may be determined according to a specific situation, and the embodiments of the present disclosure do not make restriction on this. For example, the grayscale values of all pixels in each backlight block are grayscales of a display image obtained by the data decoding circuit and the gamma correction of the nth frame input image signal.

For example, the regional eigenvalue of the (i, j)th backlight block of the (n)th frame image can be expressed as the formula (1):

$$G_{(n)}(i,j)=k*G_{(n)max}(i,j), \quad (1)$$

where k represents an adjustment coefficient, $G_{(n)}(i, j)$ represents the regional eigenvalue of the (i, j)th backlight block of the (n)th frame image, $G_{(n)max}(i, j)$ represents the maximum of grayscale values of the (i, j)th backlight block of the (n)th frame image, $1 \le i \le I$, $1 \le j \le J$, I and J are integers greater than 1, and I and J respectively represent a row number and a column number of an array in which the plurality of backlight blocks are arranged. For example, a value range of the adjustment coefficient k is 0.85 to 1.00. It should be noted that, the value range of the adjustment coefficient k depends on a specific situation, and the embodiments of the present disclosure do not limit this.

Similarly, the regional eigenvalue and grayscale value of each backlight block of the (n−1)th frame image can also be obtained by the above-mentioned method, and details are omitted here.

After acquiring the regional eigenvalue of each backlight block of two adjacent frames of images, the preset threshold can be further combined to determine whether to perform the peak driving processing on a backlight luminance of a backlight block of the current frame, That is, the backlight luminance of the backlight block is adjusted to obtain a new backlight luminance of the backlight block, which is referred to as an adjusted backlight luminance in the embodiments of the present disclosure.

For example, the preset threshold can be determined according to actual experience, and can also be determined by a conventional algorithm in the art, and the embodiments of the present disclosure do not limit this. For example, in a peak driving algorithm, the peak driving is performed on a backlight block whose regional eigenvalue is greater than the preset threshold. However, in the image display processing method provided by the embodiment of the present disclosure, in a case where the above conditions are satisfied, it is also necessary to judge whether or not the region is a static display region. If so, then the peak driving is not performed, and if not, then peak driving is performed. In this way, it is avoided that light-emitting devices of a backlight region, in which a highlighted image is consistently displayed (that is, a static display region in which the regional eigenvalue of backlight blocks is greater than the preset threshold), in the peak driving state for a long period of time, thereby avoiding the light-emitting devices of the backlight unit to be aged prematurely, which may prolong the service life of the display panel.

For example, the regional eigenvalue of each backlight block of the (n)th frame image and the regional eigenvalue of each backlight block of the (n−1)th frame image can be acquired by a regional eigenvalue acquisition circuit, and can also be achieved by a central processing unit (CPU) or a processing unit with data processing capability and/or instruction execution capability in other form. The processing unit may be a general-purpose processor or a dedicated processor, may be a processor based on X86 or ARM architecture, or the like.

Figure 3:
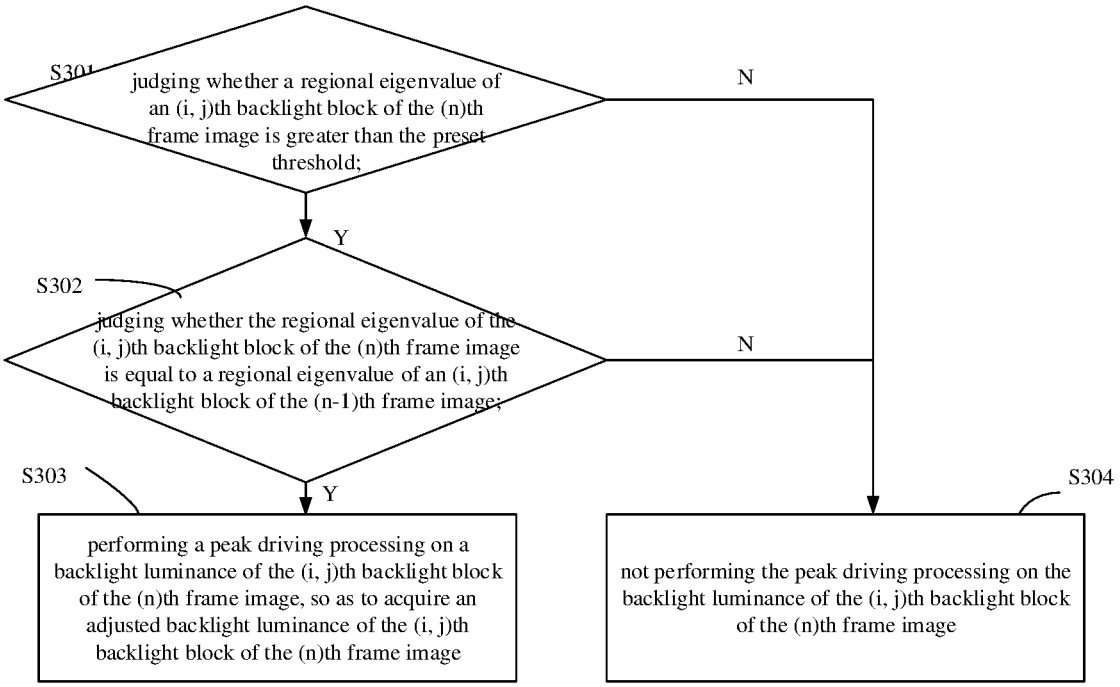
FIG. 3 is a flowchart of acquiring an adjusted backlight luminance of an image display processing method provided by an embodiment of the present disclosure.

For example, FIG. 3 is a flowchart of acquiring an adjusted backlight luminance of an image display processing method provided by some embodiments of the present disclosure. That is, FIG. 3 is a flowchart of an example of the step S202 as shown in FIG. 2. As shown in FIG. 3, a method for acquiring the adjusted backlight luminance of the image display processing method includes steps S301 to S304.

Step S301: it is judged whether a regional eigenvalue of an (i, j)th backlight block of the (n)th frame image is greater than the preset threshold; if so, step S302 is performed, otherwise step S304 is performed.

Step S302: it is judged whether the regional eigenvalue of the (i, j)th backlight block of the (n)th frame image is not equal to a regional eigenvalue of an (i, j)th backlight block of the (n−1)th frame image; If so, step S303 is performed, otherwise step S304 is performed.

Step S303: the peak driving processing is performed on a backlight luminance of the (i, j)th backlight block of the (n)th frame image, so as to acquire an adjusted backlight luminance of the (i, j)th backlight block of the (n)th frame image.

Step S304: the peak driving processing is not performed on the backlight luminance of the (i, j)th backlight block of the (n)th frame image.

It should be noted that, the order of step S301 and step S302 may be interchanged, as long as it is ensured that the peak driving processing is performed on the backlight luminance of the backlight block only when the two are satisfied simultaneously, and the embodiments of the present disclosure do not limit this.

For example, the regional eigenvalue of the (i, j)th backlight block of the (n)th frame image and the regional eigenvalue of the (i, j)th backlight block of the (n−1)th frame image can be acquired by step S201. For example, it is judged whether the regional eigenvalue of the (i, j)th backlight block of the (n)th frame image is greater than the preset threshold; at the same time, it is judged whether the regional eigenvalue of the (i, j)th backlight block of the (n)th frame image is not equal to the regional eigenvalue of the (i, j)th backlight block of the (n−1)th frame image. If the two above conditions are satisfied (that is, if it is satisfied that the display image of the current backlight block is highlighted and an non-static display image), the peak driving processing is performed on the (i, j)th backlight block. Otherwise, if either of the conditions is not satisfied, or if the two conditions are not satisfied (that is, if the display image of the current backlight block is a highlighted static image, a non-highlighted non-static display image or a non-highlighted static image), then the peak driving processing is not performed on the backlight block, that is, the backlight luminance of the backlight block is kept unchanged. In other words, the backlight luminance of the backlight block is still equal to the backlight luminance corresponding to its regional eigenvalue. Therefore, the image display processing method can avoid the light-emitting devices of the backlight region, in which a highlighted image is consistently displayed, from being in the peak driving state for a long period of time, thereby avoiding the light-emitting devices of the backlight unit to be aged prematurely, which may prolong the service life of the display panel.

For example, the peak drive processing is performed on the (i, j)th backlight block of the (n)th frame image, so as to acquire the adjusted backlight luminance of the (i, j)th backlight block, which can be done according to the following formula (2):

$$L_{1(n)}(i, j) = (1 + A) * \frac{G_{(n)}(i, j)}{Hm} * L_{max}, \tag{2}$$

where $L_{1(n)}(i, j)$ represents the adjusted backlight luminance of the (i, j)th backlight block of the (n)th frame image, A represents the backlight luminance adjustment coefficient, $G_{(n)}(i, j)$ represents the regional eigenvalue of the (i, j)th backlight block of the (n)th frame image, Hm represents the highest grayscale value, and $L_{max}$ represents the backlight luminance corresponding to the highest grayscale value Hm.

For example, the value range of the backlight luminance adjustment coefficient a in formula (2) is 0 to 1. For example, in this step, the backlight luminance adjustment coefficient a takes the value of 0.1, and as required, the backlight luminance adjustment coefficient a may take the value of 1 as well. It should be noted that, the value of the backlight luminance adjustment coefficient a depends on a specific situation, and the embodiments of the present disclosure do not limit this. For example, the larger the degree to which the regional eigenvalue of the (i, j)th backlight block is greater than the threshold of peak driving is, the bigger the value of the backlight luminance adjustment coefficient a is.

For example, when the peak driving is performed on a corresponding backlight block, the backlight luminance of the backlight block may be changed by adjusting the driving current of LEDs of the backlight block. For example, the backlight luminance adjustment coefficient a may be used to adjust the size of the light-emitting current which is for driving LEDs of the corresponding backlight block to emit light, thereby realizing adjustment of the backlight luminance of the backlight block.

For example, Hm in formula (2) may be 255, which represents the highest grayscale in the case that grayscale is expressed in 8 bytes here. Of course, if grayscale is expressed in 10 bytes, 255 may be replaced by 1023 for the above parameter Hm. The value of the highest grayscale Hm depends on a specific situation, and the embodiments of the present disclosure do not limit this.

For example, if the peak driving is not performed on the backlight luminance of the (i, j)th backlight block of the (n)th frame image after judgement is made, the backlight luminance corresponding to the regional eigenvalue of the (i, j)th backlight block of the (n)th frame image can be expressed as formula (3):

$$L_{2(n)}(i, j) = \frac{G_{(n)}(i, j)}{Hm} * L_{max}, \tag{5}$$

where $L_{2(n)}(i, j)$ represents the backlight luminance of the (i, j)th backlight block of the (n)th frame image without the peak drive processing, $G_{(n)}(i, j)$ represents the regional eigenvalue of the (i, j)th backlight block of the (n)th frame image, Hm represents the highest grayscale, and $L_{max}$ represents the backlight luminance corresponding to the highest grayscale Hm.

As can be seen from formula (2) and formula (3), if it is determined that the peak driving is not performed on the backlight luminance of the (i, j)th backlight block of the (n)th frame image, then the backlight luminance of the backlight block remains unchanged, and is still equal to the backlight luminance corresponding to its regional eigenvalue. If the peak driving processing is performed, then the backlight luminance is increased by (1+a) times, and thus the contrast of the display image is improved.

For example, the adjusted backlight luminance of each backlight block of the (n)th frame image can be acquired by an adjusted backlight luminance acquisition circuit, and it can also be achieved by a central processing unit (CPU) or a processing unit with data processing capability and/or instruction execution capability in other form.

Figure 4:
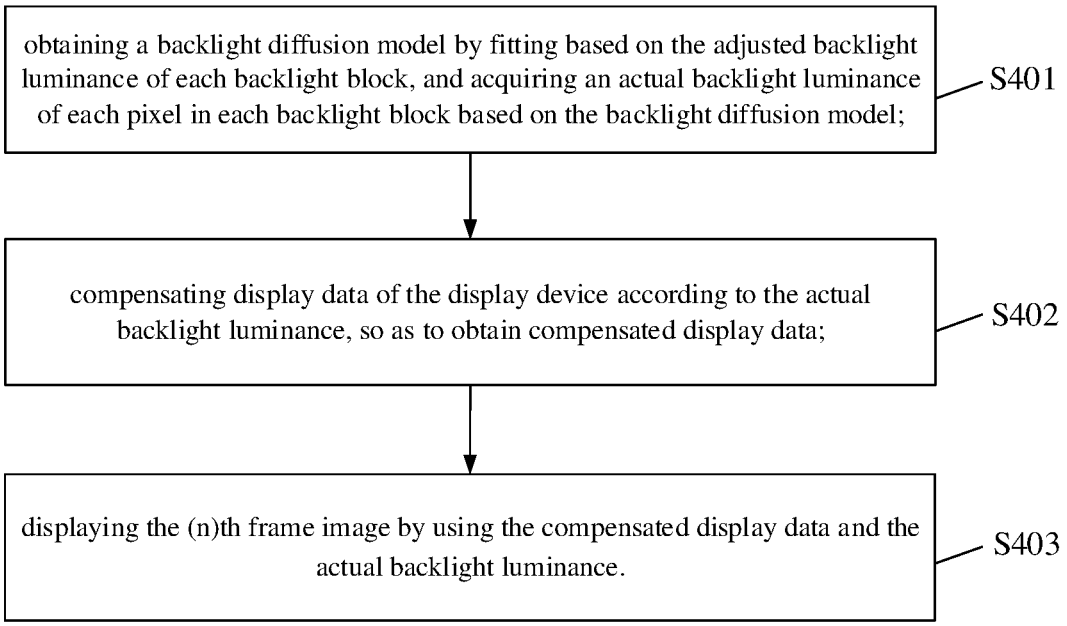
FIG. 4 is a flowchart of an image display method of an image display processing method provided by an embodiment of the present disclosure.

After the adjusted backlight luminance of each of the backlight blocks of the (n)th frame image is acquired, the (n)th frame image is displayed based on the adjusted backlight luminance that has been acquired, so as to achieve enhancement of the contrast of the display image. FIG. 4 is a flowchart of an image display method of an image display processing method provided by some embodiments of the present disclosure. That is, FIG. 4 is a flowchart of an example of step S203 as shown in FIG. 2. As shown in FIG. 4, the image display method includes steps S401 to S403.

Step S401: a backlight diffusion model is obtained by fitting based on the adjusted backlight luminance of each backlight block, and an actual backlight luminance of each pixel in each backlight block is acquired based on the backlight diffusion model.

Step S402, display data of the display device is compensated according to the actual backlight luminance, so as to obtain compensated display data.

Step S403: the (n)th frame image is displayed by using the compensated display data and the actual backlight luminance.

For example, after the adjusted backlight luminance (including $L_{1(n)}(i, j)$ and $L_{2(n)}(i, j)$) for each backlight block of the (n)th frame image is acquired by using the method as shown in FIG. 3, it is also necessary to calculate the actual backlight luminance of each pixel in each backlight block, and to calculate display data signal according to the actual backlight luminance of each pixel. For example, the display data signal can be obtained by calculation with formula (4) and formula (5) as shown below.

For example, for a pixel with a display grayscale (that is, display data signal) of x, its display luminance may be expressed as formula (4):

$$L_x = BLU_x * \eta_x, \quad (4)$$

where x represents the grayscale of the pixel, $L_x$ represents the display luminance of the pixel when the grayscale is x, $BLU_x$ represents the actual backlight luminance of the pixel when the grayscale is x, and $\eta_x$ represents transmittance corresponding to the pixel.

For example, the pixel transmittance $\eta_x$ may be expressed as formula (5):

$$\eta_x = (x/Hm)^{\gamma} * \eta_{Hm} \quad (5)$$

where $\eta_{Hm}$ represents the pixel transmittance corresponding to the maximum grayscale Hm, and $\gamma$ is a gamma value of the display device.

For example, descriptions will be made by taking the actual backlight luminance of a pixel in a backlight block as an example. Because light diffusion and other phenomenon may happen to the adjusted backlight luminance emitted by each LED in the backlight unit, the backlight luminance emitted by LEDs at different locations in the backlight unit has an effect on the actual backlight luminance of the pixel. For example, the closer the distance from the pixel to a LED is, the greater the impact of luminance emitted by the LED on the actual backlight luminance of the pixel is. Thus, by means of synthesizing the coupling of luminance emitted by individual LEDs at different distances in the backlight unit on the pixel, the actual backlight luminance of the pixel is obtained. Therefore, it is necessary that according to the distance from each LED to the pixel in each backlight block, the backlight diffusion model of the backlight block is obtained by fitting, and the actual backlight luminance corresponding to each pixel in each backlight block is obtained by calculation based on the backlight diffusion model. For example, the backlight diffusion model may be obtained by actual measurement according to a conventional method in the art, and details are omitted here.

In view of the fact that the display luminance (luminous intensity) of each pixel at a certain time in the LCD panel is not only related to the actual backlight luminance at the time, but also related to the display data (i.e., grayscale, which determines the transmittance) of the pixel. Therefore, if the backlight luminance changes after being processed by the local dimming and the peak driving, display compensation may need to be made on the display data of the pixel, so as to cause the display panel to achieve an ideal display luminance. For example, after the actual backlight luminance $BLU_x$ of each pixel in a backlight block is obtained based on the backlight diffusion model, if the ideal display luminance $L_x$ of the display panel is to be achieved, transmittance corresponding to each pixel may be obtained by calculation according to formula (4). After the transmittance is obtained, then according to the formula (5), the display data signal (i.e. grayscale value x) of each pixel is obtained by calculation, thereby achieving display compensation of the display data of a display image. For example, liquid crystal molecules located in a sub-pixel of a liquid crystal panel above the backlight source deflects accordingly based on a display data signal (e.g. a voltage signal corresponding to the grayscale value x) inputted by a data driving circuit, so as to control the transmissive degree (i.e. transmittance) of polarized lights after lights of each backlight block of the LED backlight source are transmitted by a polarizer, and thus corresponding grayscales are presented on the display screen. In turn, display of the (n)th frame image is realized.

For example, the (n)th frame image may be displayed by an image display circuit, and it may also be achieved by a central processing unit (CPU) or a processing unit having data processing capability and/or instruction execution capability in other form.

The image display processing method provided by the embodiment of the present disclosure can reduce the backlight power consumption of the backlight source, and to improve the contrast of the display image. Moreover, the problem that light-emitting devices of the backlight unit age prematurely as a result of the display panel being in the peak driving state for a long period of time and so on can be avoided, and thus, service life of the display panel can be prolonged.

For example, the regional eigenvalue of each backlight block of the (n)th frame image, the regional eigenvalue of each backlight block of the (n−1)th frame image, the preset threshold, the adjusted backlight luminance of the (i, j)th backlight block of the (n)th frame image after being processed by the peak driving processing, and other parameters generated during the image display processing, etc. in the above steps may be stored in a memory of the display panel, and if needed, they are invoked by a controller (e.g., FPGA). It should be noted that, the following embodiments are the same as this, and details are omitted.

It should be noted that, in the embodiments of the present disclosure, the process of the image display processing method may include more or less operations, and these operations may be executed sequentially or in parallel. Although the process of the image display processing method as described above includes multiple operations occurring in a particular order, it should be clearly understood that the sequence of the multiple operations is not limited. The image processing method as described above may be executed once, and may also be executed multiple times according to predetermined conditions. It should be noted that, the following embodiments are the same as this, and details are omitted.

Figure 5:
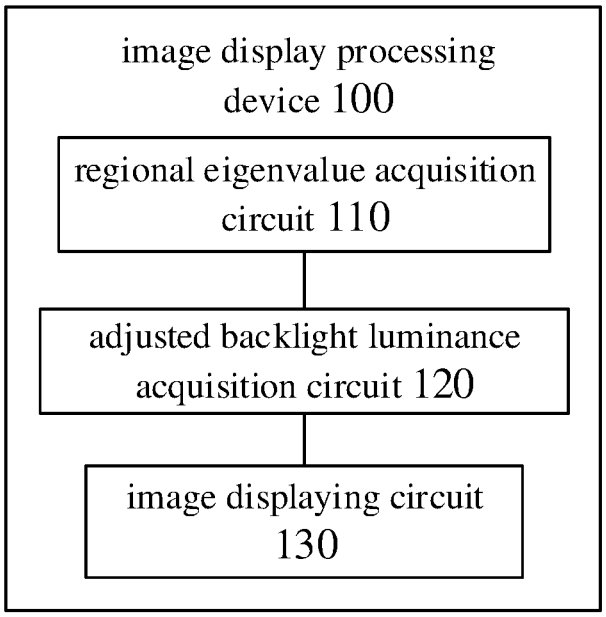
FIG. 5 is a structurally schematic diagram of an image display processing device provided by an embodiment of the present disclosure.

FIG. 5 is a structurally schematic diagram of an image display processing device provided by some embodiments of the present disclosure. The image display processing device 100 includes a regional eigenvalue acquisition circuit 110, an adjusted backlight luminance acquisition circuit 120, and an image displaying circuit 130.

The regional eigenvalue acquisition circuit 110 is configured to acquire a regional eigenvalue of each backlight block of the (n)th frame image and a regional eigenvalue of each backlight block of the (n−1)th frame image. For example, step S201 may be implemented by the regional eigenvalue acquisition circuit 110.

The adjusted backlight luminance acquisition circuit 120 is configured to perform a peak driving processing on a backlight luminance of each backlight block of the (n)th frame image, based on a preset threshold, the regional eigenvalue of each backlight block of the (n)th frame image and the regional eigenvalue of each backlight block of the (n−1)th frame image, so as to acquire an adjusted backlight luminance of each backlight block of the (n)th frame image. For example, step S202, and steps S301 to S304 may be implemented by the adjusted backlight luminance acquisition circuit 120.

The image displaying circuit 130 is configured to display the (n)th frame image based on the adjusted backlight luminance of each backlight block of the (n)th frame image.

For example, step S203 and steps S401 to S403 may be implemented by the image displaying circuit 130.

It should be noted that, in the embodiments of the present disclosure, more or less circuits may be included, and the connection relationship between the circuits is unrestricted, and may be determined according to actual demands. The concrete constituting form of each circuit is not limited, and it may be composed of analog devices according to the circuit principle, and may also be composed of digital chips, or alternatively, it is formed in other applicable way.

Regarding technical effects of the image display processing device 100, reference may be made to the technical effects of the image display processing method of the display device provided by the embodiment of the present disclosure, and details are omitted here.

Another embodiment of the present disclosure further provides an image display processing device, and the image display processing device is configured to perform the above image display processing method provided by the embodiment of the present disclosure. The image display processing device may include a processor, a memory and one or more computer program modules. For example, the processor is connected to the memory via a bus system. For example, the one or more computer program modules may be stored in the memory. For example, the one or more computer program modules may include instructions to be executed for achievement of the above image display processing method. For example, instructions in the one or more computer program modules may be executed by the processor. For example, the bus system may be a commonly used serial, parallel communication bus, etc., and the embodiments of the present disclosure do not limit this.

Regarding technical effects of the image display processing device provided by the embodiment of the present disclosure, reference may be made to the technical effects of the image display processing method of the display device provided by the embodiment of the present disclosure, and details are omitted here.

Figure 6:
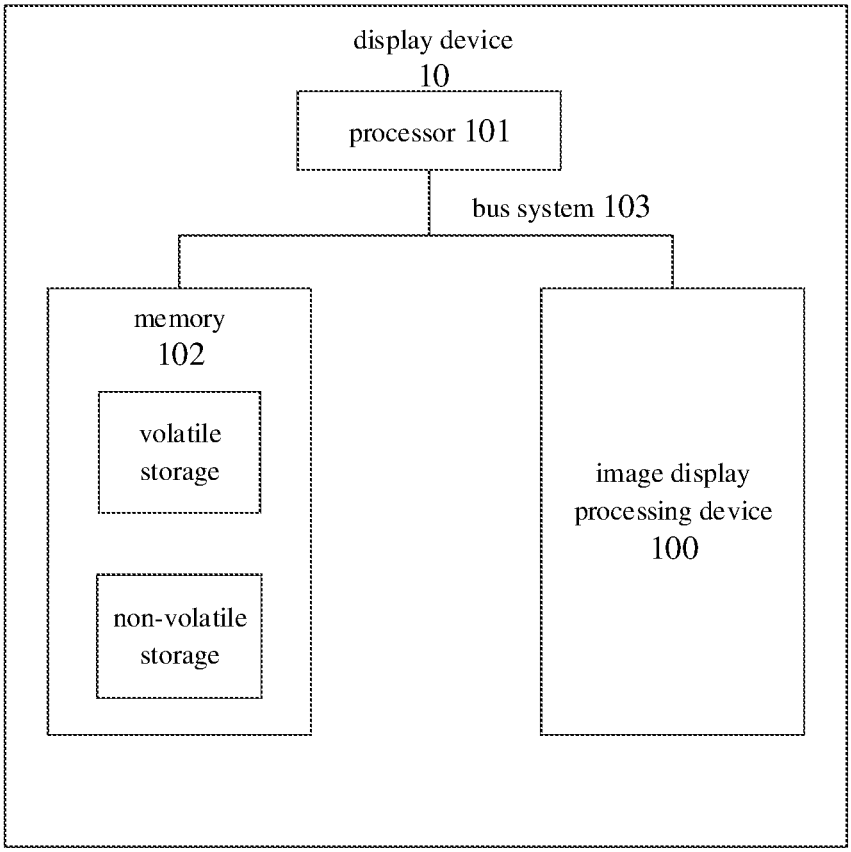
FIG. 6 is a schematic diagram for a display device provided by an embodiment of the present disclosure.

Some embodiments of the present disclosure further provide a display device 10. The display device 10 may include the image display processing device provided by any embodiment of the present disclosure. For example, the image display processing device can improve the contrast of the display image, and can avoid the problem that light-emitting devices of the backlight unit age prematurely as a result of the display panel being affected by the peak driving for a long time and so on. For example, the display device 10 may include the image display processing device 100 as shown in FIG. 5 or the image display processing device provided by other embodiment of the present disclosure. FIG. 6 is a structurally schematic diagram for a display device 10 provided by some embodiments of the present disclosure. For example, as shown in FIG. 6, the display device 10 includes a processor 101, a memory 102 and an image display processing device 100.

For example, the display device 10 may be a thin film transistor liquid crystal display device, an electronic paper display device, etc. For example, the display device 10 is a virtual reality device, such as a virtual display helmet, etc., and the embodiments of this disclosure do not limit this.

For example, these components (processor 101, memory 102 and image display processing device 100, etc.) are interconnected through a bus system 103 and/or a coupling mechanism in other form (not shown). For example, the bus system 103 may be a commonly used serial, parallel communication bus, etc., and the embodiments of the present disclosure do not limit this. It should be noted that, components and structure of the display device 10 as shown in FIG. 6 are merely exemplary, rather than restrictive, and according to requirements, the display device 10 may also have other components and structure.

For example, the processor 101 may be a central processing unit (CPU), or other processing units with a data processing ability and/or instruction execution ability. For example, the processor 101 may be a general processor or a dedicated processor, and can control other components in the display device 10 to achieve the expected functions. For example, the storage 102 can include one or a plurality of computer program productions, and the computer program productions includes a computer-readable storage media in various forms. For example, the storage 102 is a volatile storage and/or a non-volatile storage. The volatile storage, for example, includes a random access memory (RAM) and/or a cache memory, etc. The non-volatile storage, for example, includes a read-only memory (ROM), a hard disk, and a flash memory, etc. One or the plurality of computer program instructions can be stored in the computer-readable storage medium, and the processor 101 can run the program instructions to realize the functions (realized by the processor 101) in the embodiments of the present disclosure and/or other expected functions, such as an image display processing method, etc. Various applications and data, such as a preset threshold and used and/or generated by application programs, etc., can also be stored in the computer-readable storage medium.

It should be noted that in order to be clear and concise, the present embodiment of the disclosure does not illustrate all components of the display device. Those skilled in the art can provide and arrange other components, which are not illustrated in the figures, of the display device according to actual requirements to achieve necessary functions of the display device.

Technical effects of the display device 10 can be referred to the technical effects of the image display processing method provided by at least one embodiment of the present disclosure, and details are not described here again.

Some embodiments of the present disclosure also provide a non-volatile storage medium. For example, the non-volatile storage medium can store a computer-readable instruction non-transitorily, and in a case where the computer-readable instruction stored non-transitorily is executed by a computer (including a processor), the image display processing method provided by any one of the embodiments of the present disclosure may be executed.

For example, the non-volatile storage medium is any combination of one or more computer-readable storage media. For example, one computer-readable storage medium includes computer-readable program codes used for determining the boundary backlight block, and another computer-readable storage medium includes computer-readable program codes used for obtaining the backlight values of the boundary backlight blocks. For example, in a case where the program code is read by the computer, the program code stored in the computer-readable storage medium is executed by the computer, and for example, the image display processing method provided by any one of the embodiments of the present disclosure is executed.

For example, the storage media may include a memory card of a smart phone, a storage component of a tablet, a hard disk of a personal computer, a random access memory (RAM), a read-only memory (ROM), a erasable programmable read-only memory (EPROM), a portable compact disk read-only memory (CD-ROM), a flash memory, or any combination of the above-mentioned storage media, or other suitable storage media.

The foregoing merely are exemplary embodiments of the disclosure, and not intended to define the scope of the disclosure, and the scope of the disclosure is determined by the appended claims.

What is claimed is:

1. An image display processing method for a display device, wherein the display device comprises a backlight unit, the backlight unit comprises a plurality of backlight blocks and is driven by a local dimming mode, and the image display processing method comprises:

acquiring a regional eigenvalue of each backlight block of an (n)th frame image and a regional eigenvalue of each backlight block of an (n-1)th frame image;

performing a peak driving processing on a backlight luminance of each backlight block of the (n)th frame image, based on a preset threshold, the regional eigenvalue of each backlight block of the (n)th frame image, and the regional eigenvalue of each backlight block of the (n-1)th frame image, so as to acquire an adjusted backlight luminance of each backlight block of the (n)th frame image; and displaying the (n)th frame image based on the adjusted backlight luminance of each backlight block of the (n)th frame image, wherein n is an integer greater than 1;

wherein performing the peak driving processing on the backlight luminance of each backlight block of the (n)th frame image based on the preset threshold, the regional eigenvalue of each backlight block of the (n)th frame image and the regional eigenvalue of each backlight block of the (n-1)th frame image so as to acquire the adjusted backlight luminance of each backlight block of the (n)th frame image comprises:

judging whether a regional eigenvalue of an (i, j)th backlight block of the (n)th frame image is greater than the preset threshold;

judging whether the regional eigenvalue of the (i, j)th backlight block of the (n)th frame image is equal to a regional eigenvalue of an (i, j)th backlight block of the (n-1)th frame image; and in a case where the regional eigenvalue of the (i, j)th backlight block of the (n)th frame image is greater than the preset threshold, and the regional eigenvalue of the (i, j)th backlight block of the (n)th frame image is unequal to the regional eigenvalue of an (i, j)th backlight block of the (n-1)th frame image, performing a peak driving processing on a backlight luminance of the (i, j)th backlight block of the (n)th frame image, so as to acquire an adjusted backlight luminance of the (i, j)th backlight block of the (n)th frame image, otherwise, not performing the peak driving processing on the backlight luminance of the (i, j)th backlight block of the (n)th frame image, wherein $1 \le i \le I$, $1 \le j \le J$, I and J are integers greater than 1, and I and J respectively represent a row number and a column number of an array in which the plurality of backlight blocks are arranged.

2. The image display processing method according to claim 1, wherein the adjusted backlight luminance is expressed as:

$$L_{1(n)}(i, j) = (1 + A) * \frac{G_{(n)}(i, j)}{Hm} * L_{max},$$

where $L_{1(n)}(i, j)$ represents an adjusted backlight luminance of an (i, j)th backlight block of the (n)th frame image, A represents a backlight luminance adjustment coefficient, $G_{(n)}(i, j)$ represents a regional eigenvalue of the (i, j)th backlight block of the (n)th frame image, Hm represents a highest grayscale value, and $L_{max}$ represents a backlight luminance corresponding to the highest grayscale value.

3. The image display processing method according to claim 1, wherein in a case where the peak driving processing is not performed on the backlight luminance of the (i, j)th backlight block of the (n)th frame image, a backlight luminance corresponding to the regional eigenvalue of the (i, j)th backlight block of the (n)th frame image is expressed as:

$$L_{2(n)}(i, j) = \frac{G_{(n)}(i, j)}{Hm} * L_{max},$$

where $L_{2(n)}(i, j)$ represents the backlight luminance of the (i, j)th backlight block of the (n)th frame image without the peak driving processing, $G_{(n)}(i, j)$ represents the regional eigenvalue of the (i, j)th backlight block of the (n)th frame image, Hm represents a highest grayscale value, and $L_{max}$ represents a backlight luminance corresponding to the highest grayscale value Hm.

4. The image display processing method according to claim 1, wherein displaying the (n)th frame image based on the adjusted backlight luminance of each backlight block of the (n)th frame image comprises:

obtaining a backlight diffusion model by fitting based on the adjusted backlight luminance of each backlight block, and acquiring an actual backlight luminance of each pixel in each backlight block based on the backlight diffusion model;

compensating display data of the display device according to the actual backlight luminance, so as to obtain compensated display data; and displaying the (n)th frame image by using the compensated display data and the actual backlight luminance.

5. The image display processing method according to claim 1, wherein the regional eigenvalue of an (i, j)th backlight block of the (n)th frame image is expressed as:

$$G_{(n)}(i,j)=k*G_{(n)max}(i,j),$$

where k represents an adjustment coefficient, $G_{(n)}(i, j)$ represents the regional eigenvalue of the (i, j)th backlight block of the (n)th frame image, and $G_{(n)max}(i, j)$ represents a maximum of grayscale values of the (i, j)th backlight block of the (n)th frame image.

6. The image display processing method according to claim 5, wherein a value range of the adjustment coefficient is 0.85 to 1.00.

7. An image display processing device, comprising:

a regional eigenvalue acquisition circuit, configured to acquire a regional eigenvalue of each backlight block of an (n)th frame image and a regional eigenvalue of each backlight block of an (n-1)th frame image;

an adjusted backlight luminance acquisition circuit, configured to perform a peak driving processing on a backlight luminance of each backlight block of the (n)th frame image, based on a preset threshold, the regional eigenvalue of each backlight block of the (n)th frame image and the regional eigenvalue of each backlight block of the (n-1)th frame image, so as to acquire an adjusted backlight luminance of each backlight block of the (n)th frame image; and an image displaying circuit, configured to display the (n)th frame image based on the adjusted backlight luminance of each backlight block of the (n)th frame image, wherein n is an integer greater than 1, wherein performing the peak driving processing on the backlight luminance of each backlight block of the (n)th frame image based on the preset threshold, the regional eigenvalue of each backlight block of the (n)th frame image and the regional eigenvalue of each backlight block of the (n-1)th frame image so as to acquire the adjusted backlight luminance of each backlight block of the (n)th frame image comprises:

judging whether a regional eigenvalue of an (i, j)th backlight block of the (n)th frame image is greater than the preset threshold;

judging whether the regional eigenvalue of the (i, j)th backlight block of the (n)th frame image is equal to a regional eigenvalue of an (i, j)th backlight block of the (n-1)th frame image; and in a case where the regional eigenvalue of the (i, j)th backlight block of the (n)th frame image is greater than the preset threshold, and the regional eigenvalue of the (i, j)th backlight block of the (n)th frame image is unequal to the regional eigenvalue of an (i, j)th backlight block of the (n-1)th frame image, performing a peak driving processing on a backlight luminance of the (i, j)th backlight block of the (n)th frame image, so as to acquire an adjusted backlight luminance of the (i, j)th backlight block of the (n)th frame image, otherwise, not performing the peak driving processing on the backlight luminance of the (i, j)th backlight block of the (n)th frame image, wherein $1 \le i \le I$, $1 \le j \le J$, I and J are integers greater than 1, and I and J respectively represent a row number and a column number of an array in which the plurality of backlight blocks are arranged.

8. The image display processing device according to claim 7, wherein the adjusted backlight luminance is expressed as:

$$L_{1(n)}(i, j) = (1 + A) * \frac{G_{(n)}(i, j)}{Hm} * L_{max},$$

where $L_{1(n)}(i, j)$ represents an adjusted backlight luminance of an (i, j)th backlight block of the (n)th frame image, A represents a backlight luminance adjustment coefficient, $G_{(n)}(i, j)$ represents a regional eigenvalue of the (i, j)th backlight block of the (n)th frame image, Hm represents a highest grayscale value, and $L_{max}$ represents a backlight luminance corresponding to the highest grayscale value.

9. The image display processing device according to claim 7, wherein in a case where the peak driving processing is not performed on the backlight luminance of the (i, j)th backlight block of the (n)th frame image, a backlight luminance corresponding to the regional eigenvalue of the (i, j)th backlight block of the (n)th frame image is expressed as:

$$L_{2(n)}(i, j) = \frac{G_{(n)}(i, j)}{Hm} * L_{max},$$

where $L_{2(n)}(i, j)$ represents the backlight luminance of the (i, j)th backlight block of the (n)th frame image without the peak driving processing, $G_{(n)}(i, j)$ represents the regional eigenvalue of the (i, j)th backlight block of the (n)th frame image, Hm represents a highest grayscale value, and $L_{max}$ represents the backlight luminance corresponding to the highest grayscale value Hm.

10. An image display processing device, comprising:

a processor;

a memory; and one or more computer program modules, being stored in the memory and configured to be executed by the processor, and comprising instructions to be executed for implementing an image display processing method for a display device, wherein the display device comprises a backlight unit, the backlight unit comprises a plurality of backlight blocks and is driven by a local dimming mode, and the image display processing method comprises:

acquiring a regional eigenvalue of each backlight block of an (n)th frame image and a regional eigenvalue of each backlight block of an (n-1)th frame image;

performing a peak driving processing on a backlight luminance of each backlight block of the (n)th frame image, based on a preset threshold, the regional eigenvalue of each backlight block of the (n)th frame image, and the regional eigenvalue of each backlight block of the (n-1)th frame image, so as to acquire an adjusted backlight luminance of each backlight block of the (n)th frame image; and displaying the (n)th frame image based on the adjusted backlight luminance of each backlight block of the (n)th frame image, wherein n is an integer greater than 1, wherein the one or more computer program modules further comprise instructions to be executed for implementing the image display processing method, wherein performing the peak driving processing on the backlight luminance of each backlight block of the (n)th frame image based on the preset threshold, the regional eigenvalue of each backlight block of the (n)th frame image and the regional eigenvalue of each backlight block of the (n-1)th frame image so as to acquire the adjusted backlight luminance of each backlight block of the (n)th frame image comprises:

judging whether a regional eigenvalue of an (i, j)th backlight block of the (n)th frame image is greater than the preset threshold;

judging whether the regional eigenvalue of the (i, j)th backlight block of the (n)th frame image is equal to a regional eigenvalue of an (i, j)th backlight block of the (n-1)th frame image; and in a case where the regional eigenvalue of the (i, j)th backlight block of the (n)th frame image is greater than the preset threshold, and the regional eigenvalue of the (i, j)th backlight block of the (n)th frame image is unequal to the regional eigenvalue of an (i, j)th backlight block of the (n-1)th frame image, performing a peak driving processing on a backlight luminance of the (i, j)th backlight block of the (n)th frame image, so as to acquire an adjusted backlight luminance of the (i, j)th backlight block of the (n)th frame image, otherwise, not performing the peak driving processing on the backlight luminance of the (i, j)th backlight block of the (n)th frame image, wherein $1 \leq i \leq I$, $1 \leq j \leq J$, I and J are integers greater than 1, and I and J respectively represent a row number and a column number of an array in which the plurality of backlight blocks are arranged.

11. A display device, comprising the image display processing device according to claim 7.

12. A display device, comprising a processor, a memory, and the image display processing device according to claim 7, wherein the processor, the memory and the image display processing device are connected to each other through a bus system.

13. A non-volatile storage medium, in which computer readable instructions are stored non-temporarily, wherein when the non-temporary, computer readable instructions are executed by a computer, the image display processing method according to claim 1 can be executed.

* * * * *